United States Patent [19]

Straza et al.

[11] Patent Number: 4,681,322

[45] Date of Patent: Jul. 21, 1987

[54] GOLF CLUB HEAD

[76] Inventors: George T. Straza; George C. P. Straza, both of P.O. Box 1292, Rancho Santa Fe, Calif. 92067

[21] Appl. No.: 777,219

[22] Filed: Sep. 18, 1985

[51] Int. Cl.[4] ..... A63B 53/04

[52] U.S. Cl. ..... 273/173; 273/DIG. 3

[58] Field of Search ..... 273/167 J, 78, 173, 273/DIG. 3, 169, 170, 171, 172, 174

[56] References Cited

U.S. PATENT DOCUMENTS

| | | | |
|---|---|---|---|
| 1,094,599 | 4/1914 | Samson | 273/78 |
| 1,383,654 | 7/1921 | Mattern | 273/173 |
| 2,429,351 | 10/1947 | Fetterolf | 273/78 |
| 3,172,667 | 3/1965 | Baker et al. | 273/173 |
| 3,695,618 | 10/1972 | Woolley et al. | 273/78 X |
| 3,817,522 | 6/1974 | Simmons | 273/78 |
| 3,847,399 | 11/1974 | Raymont | 273/167 F |
| 3,852,150 | 12/1974 | Weller | 273/78 X |

*Primary Examiner*—George J. Marlo

*Attorney, Agent, or Firm*—Brown, Martin, Haller & Meador

[57] ABSTRACT

A golf club head for impacting a golf ball is disclosed. A wooden club body has a phenolic insert embedded in the center of the body ball striking face. The insert is secured in place in a vertical channel in the body striking face by solidified epoxy which interlocks communicating passages formed in the sides of the body channel and cavities in the insert. A metal honeycomb structure is supported in a central slot in the insert. A resin compound fills and covers the honeycomb structure. The exterior surface of the resin covering the honeycomb structure provides the intended golf ball impact surface of the golf club head.

11 Claims, 6 Drawing Figures

GOLF CLUB HEAD

BACKGROUND OF THE INVENTION

The invention relates to golf club heads attachable to a golf club shaft, and more particularly to a wooden golf club head having a metal honeycomb structure backing a solidified resin compound club head impact area.

In the game of golf there is constant search for clubs which will accurately propel a golf ball greater distances. This is particularly true for clubs used in driving a golf ball from the tee and in longer fairway shots. Golf clubs with wooden heads are generally used for the latter purposes because of the greater momentum provided by the increased mass of wooden club heads. Continuing efforts have been made to improve the performance and durability of wooden club heads within the restraints imposed by the official rules governing golf club construction. Many improvements have been directed toward increasing the strength and hardness of wood club head striking faces by use of inserts therein of various configurations and materials in an effort to provide a club head which will impart the maximum momentum to a ball as a result of the golfer's swing. There are, however, limits to acceptable hardness of golf ball striking surfaces. If the resilience of the club striking face is virtually eliminated, the golf ball tends to come off the striking surface too rapidly, and control of the ball's flight is thereby sacrificed.

It is therefore desirable to provide a wooden golf club head which has improved mass and momentum transfer characteristics combined with better golf ball flight control. Applicant's golf club head meets these and other requirements.

SUMMARY OF THE INVENTION

According to the precepts of the invention, a golf club body formed of parsimmon wood is provided with a hard linen fiber phenolic insert embedded in the body golf ball striking face. The insert is securely held in place by solidified epoxy which fills and interlocks passages in the wood body which are in communication with cavities formed in the insert. Mounted partially within undercut side portions of a slot in the insert is a metal honeycomb structure supported by the insert. The honeycomb structure is a continuous matrix of elongated open cells formed with adjoining cell walls. The longitudinal axes of the cells are oriented within the insert to be perpendicular to the club body ball striking face. A solidified resin compound fills and covers the honeycomb structure, and has an exterior surface coplanar with the club body striking face to form the intended golf ball impact surface, or "sweet spot", of the applicants' golf club head design. The primary advantage of the invention is to provide a new and improved golf club head which enables a golfer to obtain both greater distance and ball control when making a golf shot. The club head is handsome, precision made, strong and durable. These together with other advantages will become apparent in considering the details of construction of the golf club head as they are more fully described. Reference will be made to the accompanying drawings wherein like numerals refer to like parts throughout.

DETAILED DESCRIPTION OF THE DRAWINGS

Figure 1:
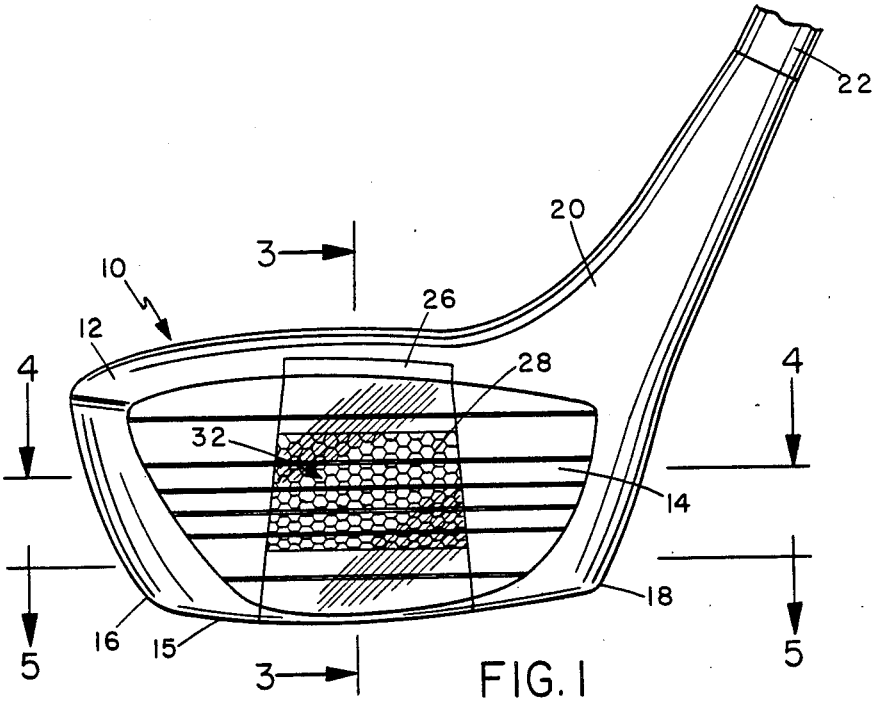
FIG. 1 is a front elevation view of a golf club head incorporating the honeycomb insert.
Figure 2:
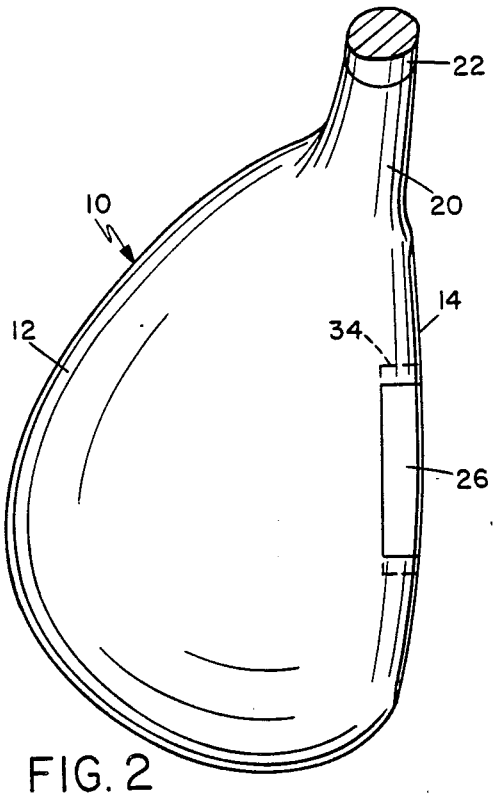
FIG. 2 is a top plan view of the golf club head.

The appearance and configuration of a wooden golf club head 10 embodying the features of applicants' invention is illustrated in FIGS. 1 and 2. The club head 10 has a wooden body 12 formed with a golf ball striking face 14, a club head sole 15, a toe portion 16 and a heel portion 18. A neck 20 of the wooden body 12 is connectable to a golf club shaft 22. The club head body 12 is formed from parsimmon wood that has been treated first to remove air and moisture from the body and then impregnated with controlled amounts of oil under a pressure at 200 pounds per square inch to provide a dense and moisture resistant wooden body 12 of desired weight. An insert of linen phenolic fiber material containing a metal honeycomb structure 28 is secured in the striking face 14 of the wooden body 12. The honeycomb structure 28 is filled and covered with a solidified resilient resin compound 30, the exterior surface of which forms the intended golf ball impact surface 32, or "sweet spot" of the golf club head 10.

Figure 5:
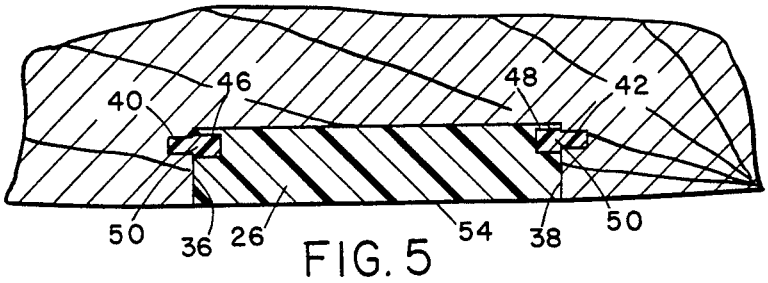
FIG. 5 is an enlarged sectional view taken on line 5—5 of FIG. 1.
Figure 6:
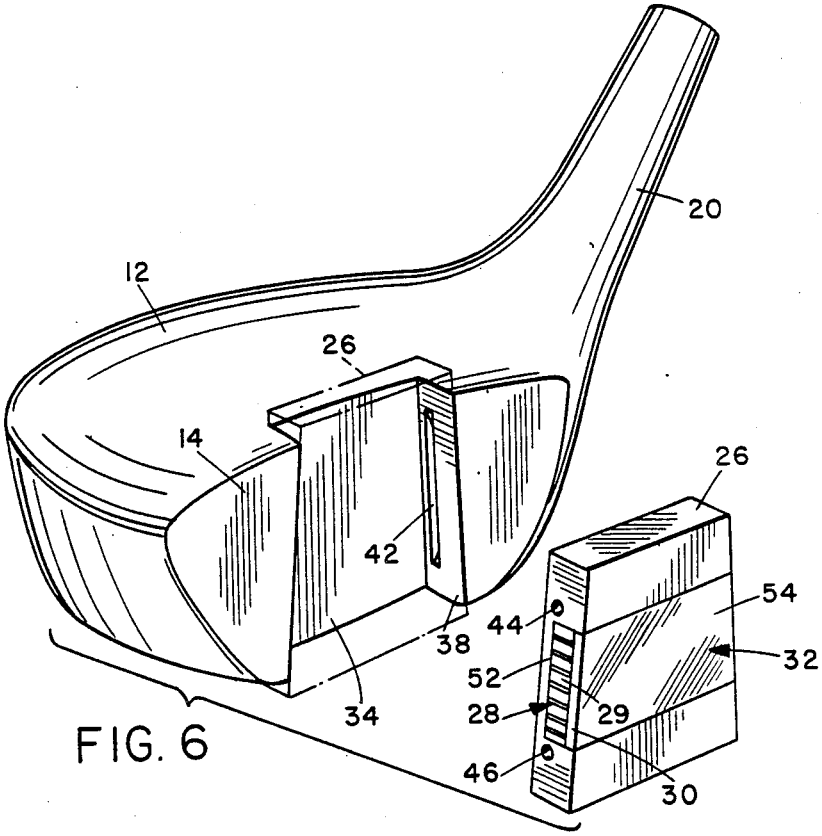
FIG. 6 is an exploded prospective view of an unassembled golf club body and insert.

FIGS. 5 and 6 further depict the placement of the insert 26 in the striking face 14 of the wood body 12 to position the intended ball impact surface 32 therein and illustrate the structure which provides for a positive permanent interlocked relationship between an installed insert 26 and the wooden body 12. As illustrated, the insert 26 has a trapezoidal configuration and fits into a similarly shaped vertical channel 34 in the body 12 which is substantially perpendicular to the sole 15 of the club head, and centered between the toe and heel portions 16 and 18 respectively of the striking face 14. The sides 36 and 38 of the channel 34 are undercut to form elongated passages 40 and 42 therein. The insert 26 is formed with pairs of cavities in the vertical edges of the insert. The cavities 44 and 46 in the toe edge of the insert 26 are illustrated in FIG. 6, but it should be understood that there are corresponding cavities on the opposite edge of the insert 26. The lower heel edge cavity of the insert 26 is illustrated at 48 in FIG. 5. When the insert 26 is positioned within the body 12, the edge cavities of the insert are in flow communication with the elongated passages 40 and 42 of the channel 34. To lock the insert 26 in place within the channel 34, epoxy 50 in liquid form is used to fill the undercut body passages 40 and 42 and the insert cavities at the time the insert is fitted into the channel 34. When the epoxy hardens, a secure and permanent bond is established between the insert 26 and the body 12 by virtue of the solidified epoxy which occupies the communicating passages and cavities of these elements. In the embodiment illustrated, commercially available epoxy produced by B & J is employed. The bond supplied by the epoxy 50 is sufficient to maintain the insert 26 within the channel 34 without additional means of attachment.

Figure 3:
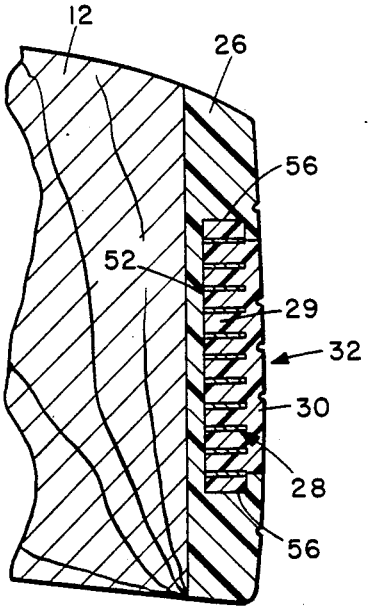
FIG. 3 is an enlarged sectional view taken on line 3—3 of FIG. 1.
Figure 4:
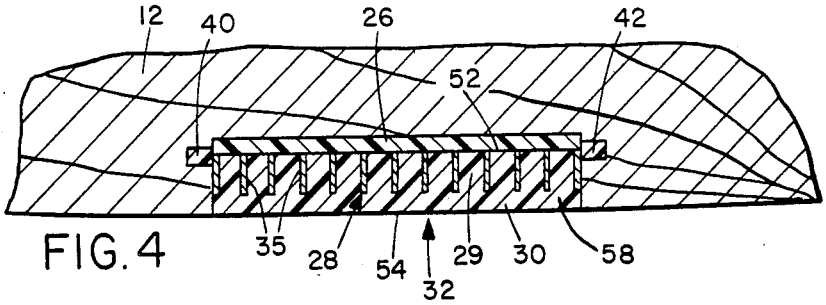
FIG. 4 is an enlarged sectional view taken on line 4—4 of FIG. 1.

Further details of the construction of the club body insert 26 is depicted in FIGS. 1, 3 and 4. The insert 26 is formed of linen phenolic fiber material to take advantage of the extreme strength and hardness of this material. An insert consisting solely of this material, however, would be too hard and cause a golf ball to leave the club's impact area surface in an uncontrolled fashion. To overcome the latter disadvantage, while capitalizing upon the virtues of the illustrated linen phenolic insert, applicants' design provides for a combination of components of decreasing resilience within the insert. This is accomplished by providing a metal honeycomb structure 28 fitted within a horizontal slot 52 formed in the front face of the insert 26. The upper and lower sides of the slot 52 have undercut sections as indicated at 56 in FIG. 3 for receiving the upper and lower edge portions of the honeycomb structure 28 to secure the structure in place within the insert slot 52. In the illustrated embodiment, the honeycomb structure comprises an array of hexagonal shaped, open ended and elongate cells which adjoin one another in a honeycomb-like structure as shown in FIG. 1. The cell walls may be formed of any suitable metal, such as HASTALOY-X or other metals. The cells of the honeycomb structure 28 as formed have one-sixteenth inch bores 29 open at each end, but upon assembly of the insert 26, the open cells are filled and covered by a solidified resin compound 30. The exterior surface 54 (FIG. 6) of the resilient resin covering the honeycomb structure forms the intended golf ball impact surface area 32 of the insert 26. In the embodiment described, the resin compound 30 is composed a suitable epoxy resin formed from a mixture of a suitable resin and a hardener. In a preferred embodiment, of an 11 hardener and 900 resin compound is used.

As further illustrated in FIGS. 1, 3 and 4, the honeycomb structure 28 is a planar trapezoidal matrix of hexagonal elongated cells having adjoining side walls depicted at 35. The honeycomb structure is positioned in the insert slot 52 such that the elongated axes of the cells are perpendicular to the club head striking face. The orientation of the honeycomb structure provides increased rigidity and hardness to the club head intended impact surface area 32 in addition to supporting the resin compound to prevent damage to the resin during club head use. The solidified resin compound 30 fills the cells and the insert undercut passages 56 to further secure the honeycomb structure in place within the insert slot 52. In the illustrated embodiment, the side walls 35 of the cells have a length of one-eighth of an inch. The resin compound 30 fills the cells and covers the open ended face of the honeycomb structure with a layer 58 of thickness 0.04 to 0.05 inches, so that the cells are effectively embedded within the resin compound 30.

As a consequence of applicants' design, when a golf ball is struck by the club head 10 at the intended impact surface area 32, it is first impacted by the resilient resin compound layer 58. The resilient layer 58 absorbs the ball allowing it to stay on the club face long enough to be compressed and directed. The energy and heat of the impact is transmitted through the resin compound to be reflected and focused first by the less resilient resin filled honeycomb structure, and finally by the phenolic insert 26 and wooden body 12. As a result of this construction, it has been found that a golf ball may be hit longer, straighter, and with increased control by the club head 10.

While the present invention has been illustrated and described by means of a particular embodiment and application, it is to be understood that changes and modifications may be made therein without departing from the spirit and scope of the invention as defined in the appended claims.

Having described our invention, what is claimed is:

1. A golf club head having a front, ball striking face for hitting a golf ball, the head comprising:

a head member of wooden material having a channel in its front face, and means for securing the head member to a golf club shaft;

an insert member for mounting in the channel in the front face of the head member, the insert member being shaped to fit the channel with its front face substantially flush with the front face of the head member;

securing means for securing the insert member in the channel;

the insert member having a cut-out in its front face;

a resilient material filling the cut-out having an outer face flush with the front face of the insert member; and a cellular honeycomb structure embedded within the resilient material in the cut-out, the structure comprising a plurality of adjoining elongated, open ended cells extending perpendicular to the front face of the insert member.

2. The golf club head according to claim 1, wherein the resilient material fills the cells of the honeycomb structure and covers the open ends of the cells to form a layer of predetermined thickness between the open ends of the cells and the front face of the insert member.

3. The golf club head according to claim 2, wherein the layer of resilient material above the open ends of the cells has a thickness between 0.04 and 0.05 inches.

4. The golf club head according to claim 1, wherein said channel and said insert member each have recesses formed in their opposite side faces, the recesses being positioned for communication with one another when said insert member is mounted in said channel, and said securing means comprises bonding material filling said recesses in said channel and insert member side faces to bond said insert member to said head member.

5. The golf club head according to claim 1, wherein said cellular honeycomb structure is formed of metal.

6. The golf club head according to claim 1, wherein said insert member cut-out comprises a horizontal, open ended slot, and the opposite, upper and lower faces of said cut-out have undercut slots for receiving and retaining the corresponding upper and lower edges of said cellular honeycomb structure.

7. An insert for a golf club head, comprising:

an insert member shaped to fit in a channel in the front face of a golf club head, the member having a front, ball striking face for lying flush with the front face of a golf club head, and interlocking means for securing the member to a golf club head;

the insert member having a cut out in its front face;

a cellular, honeycomb structure secured within the cut out;

the honeycomb structure comprising a plurality of adjoining, elongated, open cells orientated perpendicular to the front face of the insert member; and resilient material filling the cut-out around the cells to form a front face flush with the front face of the insert member.

8. The insert as claimed in claim 7, wherein the resilient material forms a layer of predetermined thickness over the open ends of the cells.

9. The insert as claimed in claim 8, wherein the layer is of thickness between 0.04 and 0.05 inches.

10. The insert as claimed in claim 7, wherein the cut-out comprises an open ended horizontal slot extending between the opposite side faces of the insert member, the slot having opposite upper and lower faces having undercut recesses for receiving the opposite upper and lower edges of the honeycomb structure to retain the structure with the cut out.

11. The insert as claimed in claim 7, wherein the insert member is of a material harder than the resilient material filling the cut-out.

* * * * *

UNITED STATES PATENT AND TRADEMARK OFFICE

CERTIFICATE OF CORRECTION

PATENT NO. : 4,681,322

DATED : July 21, 1987

INVENTOR(S) : George T. Straza, et al.

It is certified that error appears in the above-identified patent and that said Letters Patent is hereby corrected as shown below:

Claim 10, column 6, line 5, the word "with"

should be --within--;

Signed and Sealed this

First Day of December, 1987

*Attest:*

*Attesting Officer*

DONALD J. QUIGG

*Commissioner of Patents and Trademarks*